US011452372B2

(12) United States Patent
Wei

(10) Patent No.: US 11,452,372 B2
(45) Date of Patent: Sep. 27, 2022

(54) CONFIGURABLE STORAGE AND DISPLAY FRAME

(71) Applicant: Frank Wei, Valencia, CA (US)

(72) Inventor: Frank Wei, Valencia, CA (US)

( * ) Notice: Subject to any disclaimer, the term of this patent is extended or adjusted under 35 U.S.C. 154(b) by 0 days.

(21) Appl. No.: 17/175,483

(22) Filed: Feb. 12, 2021

(65) Prior Publication Data

US 2022/0257008 A1 Aug. 18, 2022

(51) Int. Cl.

| | |
|---|---|
| ***A47B 47/00*** | (2006.01) |
| ***A47F 3/14*** | (2006.01) |
| ***A47F 3/00*** | (2006.01) |

(52) U.S. Cl.

CPC ..... *A47B 47/0033* (2013.01); *A47B 47/0016* (2013.01); *A47F 3/004* (2013.01); *A47F 3/147* (2013.01)

(58) Field of Classification Search

CPC . A47B 47/0033; A47B 47/0016; A47F 3/004; A47F 3/147

See application file for complete search history.

(56) References Cited

U.S. PATENT DOCUMENTS 3,834,549 A * 9/1974 Burg ..... A47B 47/0016 403/175
3,913,289 A * 10/1975 Recker ..... E04B 1/1903 211/188
3,955,510 A * 5/1976 Kinik ..... A47B 47/0033 403/171
4,124,958 A * 11/1978 Chiche ..... F16B 5/0614 446/114
4,493,425 A * 1/1985 Yoshida ..... A47B 47/0033 211/186
4,515,280 A * 5/1985 Sheu ..... A47B 47/0033 211/186
4,901,490 A * 2/1990 Zinniel ..... E04F 15/02452 248/644
5,069,572 A * 12/1991 Niksic ..... F16B 7/0486 135/147
5,333,423 A * 8/1994 Propst ..... E04F 15/02476 248/188

(Continued)

FOREIGN PATENT DOCUMENTS

DE 2128222 A1 * 1/1973
DE 2549767 A1 * 5/1977

(Continued)

*Primary Examiner* — Stanton L Krycinski
(74) *Attorney, Agent, or Firm* — Tsz Lung Yeung

(57) ABSTRACT

A configurable storage and display frame includes a plurality of frame panels and a plurality of connecting joints. Each of the connecting joints include a base having a plurality of receiving slots and a securing member. The securing member includes a plurality of securing arms and a plurality of securing slots formed on the securing arms respectively. Connecting members of two of the frame panels are arranged to be securely received in the securing slots respectively, wherein the securing member is arranged to detachably attach on the base in such a manner that the securing arms are received in the receiving slots respectively so as to securely restrict a lateral movement between the securing member and the base for providing a joint of the connecting members of two of the corresponding frame panels.

12 Claims, 11 Drawing Sheets

FIG. 6

(56) References Cited

U.S. PATENT DOCUMENTS 5,624,200 A * 4/1997 Beaulieu ..... F16B 12/32 403/174
5,715,956 A * 2/1998 Yoshida ..... A47B 96/06 211/186
5,918,998 A * 7/1999 Pourmand ..... E04B 1/2604 403/171
6,669,036 B1 * 12/2003 Yang ..... A47B 47/0033 D21/488
D506,613 S * 6/2005 Gusdorf ..... D6/675
D555,399 S * 11/2007 Tsai ..... D6/675.1
7,841,572 B2 * 11/2010 Chen ..... A63H 33/006 446/228
7,963,404 B2 * 6/2011 Shang ..... A47F 7/08 211/36
8,051,535 B2 * 11/2011 Cheng ..... A47B 47/0033 16/320
8,360,085 B2 * 1/2013 Lee ..... E04H 15/48 135/135
8,955,928 B2 * 2/2015 Cheng ..... A47F 5/0018 312/265.2
9,089,212 B2 * 7/2015 Chang ..... A47B 47/0016
9,226,576 B2 * 1/2016 Shang ..... A47B 47/0033
9,420,883 B2 * 8/2016 Lai ..... A47B 47/0016
9,445,666 B2 * 9/2016 Chang ..... A47B 55/02
10,244,864 B2 * 4/2019 Bensen ..... F16B 9/05
10,267,035 B2 * 4/2019 Schreck ..... A47B 47/0091
10,473,260 B2 * 11/2019 McPhillips ..... F16M 11/041
10,881,200 B2 * 1/2021 Feldman ..... A01K 1/035
2004/0131416 A1 * 7/2004 Wu ..... A47B 47/0033 403/170
2004/0134869 A1 * 7/2004 Yang ..... A47F 5/14 211/181.1
2009/0020669 A1 * 1/2009 Wang ..... A47B 43/04 248/220.1
2009/0166356 A1 * 7/2009 Tsai ..... A47F 3/12 220/4.01
2010/0277045 A1 * 11/2010 Cheng ..... A47B 47/0033 312/263
2012/0009010 A1 * 1/2012 Wu ..... F16B 7/048 403/217
2014/0069882 A1 * 3/2014 Cheng ..... A47F 5/0018 403/65
2015/0069894 A1 * 3/2015 Shang ..... A47B 47/0075 312/265.5
2015/0076099 A1 * 3/2015 Chang ..... A47F 5/132 211/186
2016/0066688 A1 * 3/2016 Yu ..... A47B 47/0075 312/265.5
2016/0227924 A1 * 8/2016 Chen ..... A47B 47/0033
2022/0061521 A1 * 3/2022 Schwartz ..... A47B 41/06

FOREIGN PATENT DOCUMENTS

DE 29706495 U1 * 7/1997 ..... A47B 47/0016
EP 0700704 A1 * 3/1996
FR 2571449 A1 * 4/1986
KR 20110001745 U * 2/2011
KR 20120000989 U * 2/2012
NL 1008901 C1 * 10/1999
WO WO-2005076739 A2 * 8/2005 ..... A47B 47/0033

* cited by examiner

CONFIGURABLE STORAGE AND DISPLAY FRAME

BACKGROUND

Field of Invention

The present invention relates to a frame, and more particularly to a configurable storage and display frame which may be made up by two frame panels jointed by at least one connecting joint.

Description of Related Arts

A conventional configurable storage bin usually comprises a plurality of supporting frames and a plurality of joints detachably attached on the supporting frames for joint them to form a predetermined structure. Each of the supporting frames usually has a plurality of meshes and four boundary edge members for coupling with the joints. A user may be able to utilize several supporting frames and joints to form a predetermined or a desirable structure of the configurable storage bin. For example, a configurable storage bin having a cubic structure may utilize five supporting frames and eight joints in which each of the joints is arranged to connect two or more corresponding supporting frames.

As shown in FIG. 1 of the drawings, a conventional joint usually comprises a base 10P and a plurality of mounting members 20P extended from the base 10P, in such a manner that each two of the mounting members 20P may form a mounting channel 21P therebetween for receiving a corresponding boundary edge member of a corresponding supporting frame. The exemplary joint as shown in FIG. 1 of the drawings has altogether four mounting channels 21P which are arranged to receive the boundary edge members of four different or adjacent supporting frames.

A major disadvantage of conventional configurable storage bins such as the one described above is that when a user wants to attach or detach the joint on or away from the supporting frames, he has to manually push or pull the joint toward or away from the corresponding supporting frame. This means that the boundary edges of the supporting frames may be pushed into or pulled away from the mounting channels 21P. In order to allow the boundary edges to be securely accommodated in the mounting channels 21P, a width of each of the mounting channels 21P is designed to tight-fit a diameter of the boundary edges so that when one boundary edge is inserted into a mounting channel 21P, the corresponding mounting members 20P may slightly deform to apply elastic force toward the boundary edge so as to retain it in the mounting channel 21P.

Thus, when the conventional configurable storage bin has been used for a certain period of time, the inherent elasticity of the mounting channels 21P may decrease so that the boundary edges will not be able to securely receive in the mounting channels 21P. Moreover, it is very easy for a user to break some of the mounting members 20P when he or she is trying to push or pull the boundary edges into or away from the mounting channels 21P. Furthermore, when the conventional configurable storage bin is configured to have several storage cavities, it can be very hard for a user to disassemble the whole structure because each of the joints may attach to boundary edges belonging to different supporting frames.

Another disadvantage of the conventional configurable storage bins such as the one described above is that the supporting frames and the joints cannot be configured as a display rack to hang objects since the frames may be pulled out from the non-secured mounting slot 21P if the hanging objects' weights overcome the elastic clamping force from a pair of the corresponding mounting members 20P. This is also the reason why the conventional configurable storage bins such as the one mentioned above can only stand upright on a support ground.

As a result, there is a need to develop a configurable storage and display rack which has an enhanced durability and reliability, and which may allow a more flexible configuration.

SUMMARY OF THE PRESENT INVENTION

Certain variations of present invention provide a configurable storage and display frame which may be made up by two frame panels jointed by at least one connecting joint.

Certain variations of present invention provide a configurable storage and display frame which may be selectively configured to form a storage rack or a display rack depending on the circumstances in which the present invention is utilized.

Certain variations of present invention provide a configurable storage and display frame which may be assembled to form a storage or display rack, wherein the storage or display rack may stand upright or may be hanged on an angled or elevated surface such as a vertical wall or ceiling.

In one aspect of embodiments of the present disclosure, it provides a configurable storage and display frame, comprising:

a plurality of frame panels, each of the frame panels having at least one connecting member;

a plurality of connecting joints, each of which comprises:

a base having a plurality of receiving slots formed thereon; and a securing member which comprises a plurality of securing arms and a plurality of securing slots formed on the securing arms respectively, the connecting members of two of the frame panels being arranged to be securely received in the securing slots respectively, wherein the securing member is arranged to detachably attach on the base in such a manner that the securing arms are received in the receiving slots respectively so as to securely restrict a lateral movement between the securing member and the base for providing a joint of the connecting members of two of the corresponding frame panels.

In another aspect of embodiments of the present disclosure, it provides a connecting joint for joining at least two frame panels each having a connecting member, comprising:

a base having a plurality of receiving slots formed thereon; and a securing member which comprises a plurality of securing arms and a plurality of securing slots formed on the securing arms respectively, the connecting members of two of the frame panels being arranged to be securely received in the securing slots respectively, wherein the securing member is arranged to detachably attach on the base in such a manner that the securing arms are received in the receiving slots respectively so as to securely restrict a lateral movement between the securing member and the base for providing a joint of the connecting members of two of the corresponding frame panels.

This summary presented above is provided merely to introduce certain concepts and not to identify any key or essential features of the claimed subject matter.

DETAILED DESCRIPTION OF THE PREFERRED EMBODIMENT

Figure 1:
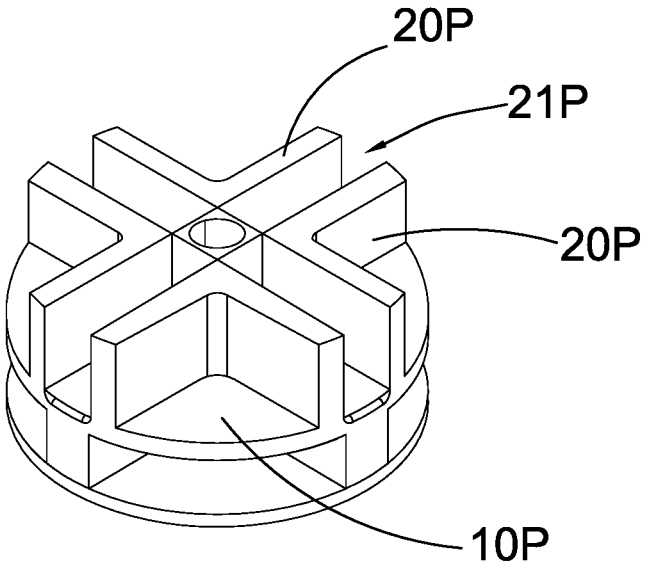
FIG.1 PRIOR ART
FIG. 1 is a conventional joint for a conventional configurable storage bin.

The following detailed description of the preferred embodiment is the preferred mode of carrying out the present disclosure. The description is not to be taken in any limiting sense. It is presented for the purpose of illustrating the general principles of embodiments of the present disclosure.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection or connection through connecting pipes. Furthermore, "connected" may also mean direct connection or indirect connection, or connection through other auxiliary components, such as at least one connecting pipe 100 or at least one air conduit. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Referring to FIG. 2 to FIG. 5 of the drawings, a configurable storage and display frame according to a preferred embodiment of the present disclosure is illustrated. Broadly, the configurable storage and display frame may comprise a plurality of frame panels 10 and a plurality of connecting joints 20. Each of the frame panels 10 may have at least one connecting member 11.

Each of the connecting joints 20 may comprise a base 21 having a plurality of receiving slots 211 formed thereon, and a securing member 22. The securing member 22 may comprise a plurality of securing arms 221 and a plurality of securing slots 222 formed on the securing arms 221 respectively. The connecting members 11 of two of the frame panels 10 may be arranged to be securely received in the securing slots 222 respectively, wherein the securing member 22 is arranged to detachably attach on the base 21 in such a manner that the securing arms 221 may be received in the receiving slots 211 respectively so as to securely restrict a lateral movement between the securing member 22 and the base 21 for providing a joint of the connecting members 11 of two of the corresponding frame panels 10.

Figure 2:
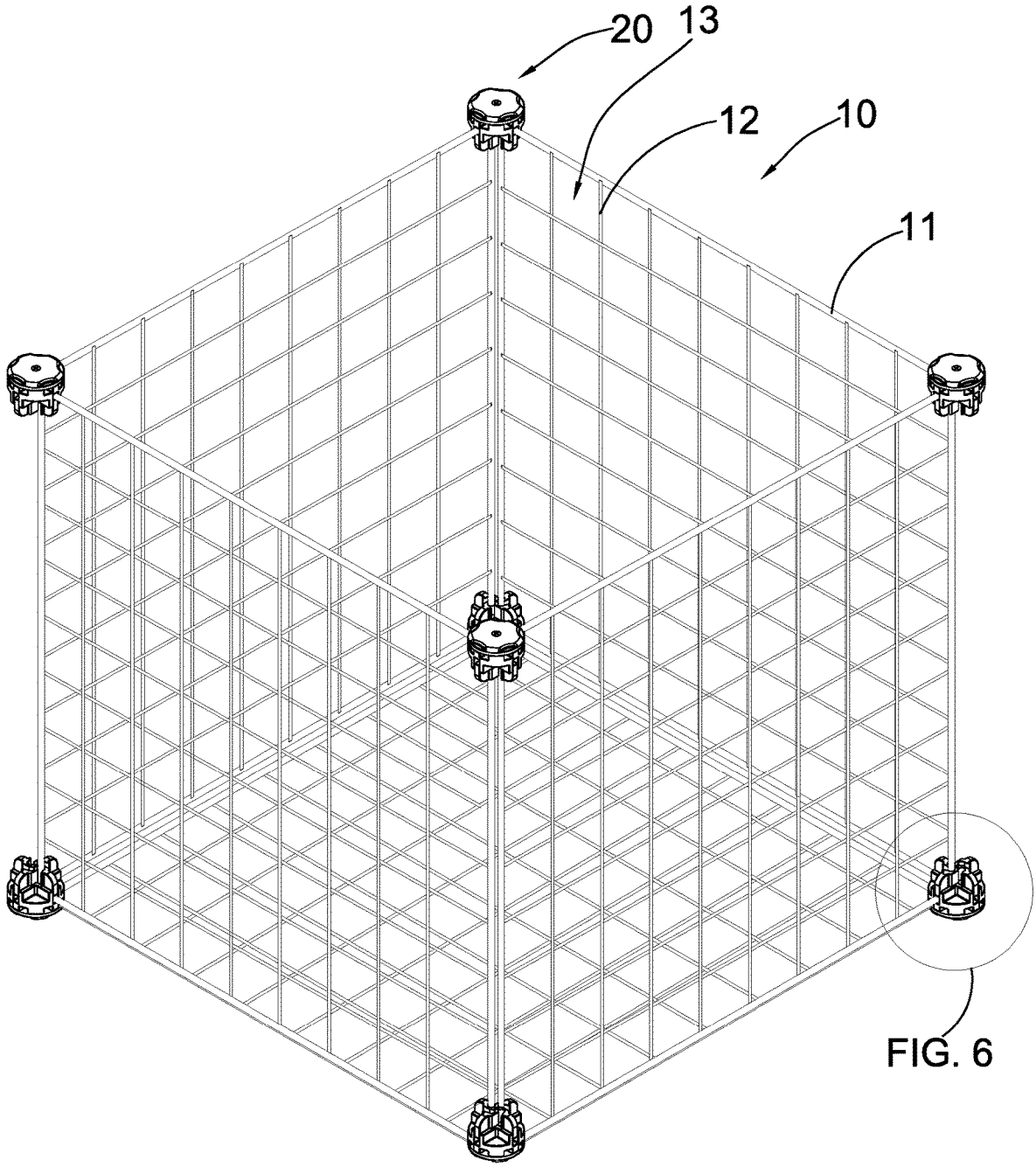
FIG. 2 is a schematic diagram of a frame panel of the configurable storage and display frame according to a preferred embodiment of the present invention, illustrating an exemplary configuration of the configurable storage and display frame.

According to the preferred embodiment of the present invention, the configurable storage and display frame may comprise a plurality of frame panels 10 connected by the connecting joints 20 to form a predetermined structure, such as a cubic structure as shown in FIG. 2 of the drawings. It is important to mention that apart from the cubic structure as shown in FIG. 2 of the drawings, other configurations are also possible.

As shown in FIG. 2 of the drawings, each of the frame panels 10 may comprise a plurality of connecting members 11 each of which may be connected with at least one of another connecting members 11 for forming an outer boundary of the corresponding frame panel 10. Each of the frame panel 10 may also comprise a plurality of frame members 12 each extending between two of the connecting members 11 and across other frame members 12 to form a plurality of through slots 13.

The connecting members 11 may be connected to form a substantially square outer boundary of the frame panel 10 while each of the frame members 12 may extend across two opposite connecting members 11 and other frame members 12 for forming the through slots 13. Thus, each of the through slots 13 may be formed by the frame members 12 or by the frame members 12 and at least one of the connecting members 11. In this preferred embodiment of the present invention, each of the through slots 13 may have a square cross-sectional shape. It worth to mentioning that frame member 12 can be in the form of a flat sheet instead of individual rods, to form a frame panel 10 with less through slots 13 or no through slot 13 at all. The connecting joints 20 may be mounted on the connecting members 11 for connecting two frame panels 10 to form a desirable structure.

Figure 3:
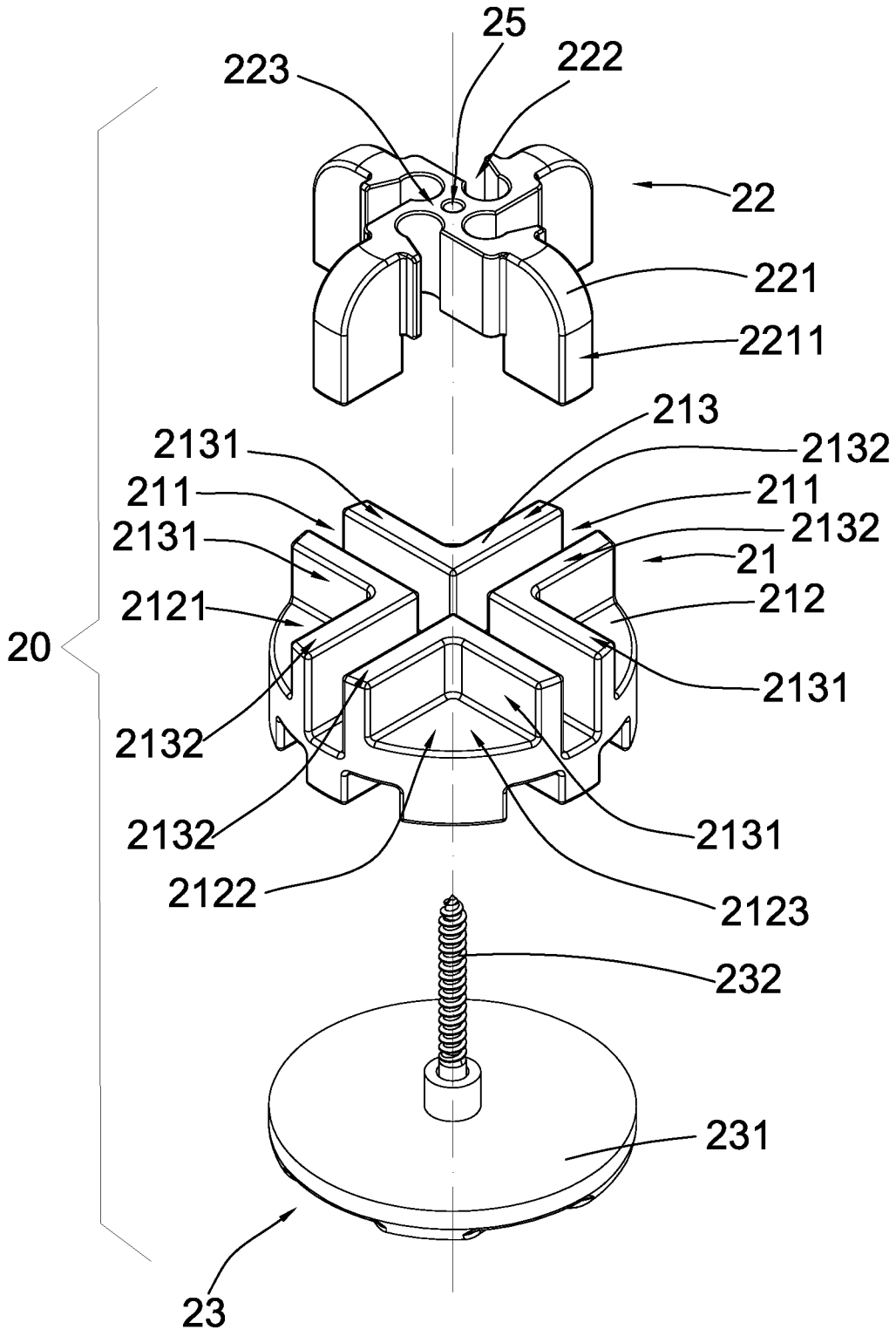
FIG. 3 is an exploded perspective view of a connecting joint of the configurable storage and display frame according to the preferred embodiment of the present invention.

Referring to FIG. 3 of the drawings, each of the connecting joints 20 may comprise the base 21 and the securing member 22. The base 21 may comprise a base body 212 and a plurality of coupling members 213 spacedly extended from the base body 212 along an axial direction thereof. Each of the coupling members 213 may have a first coupling portion 2131 and a second coupling portion 2132 extended from the first coupling portion 2131 along a transverse direction thereof so as to form a substantially L-shaped cross section for each of the coupling members 213.

In this preferred embodiment, as an exemplary configuration, the base body 212 may have a substantially circular cross-sectional shape when viewed from the front while the base 21 may comprise four coupling members 213 each having the first coupling portion 2131 and the second coupling portion 2132. The four coupling members 213 may be provided on four quadrants portions of the base body 212 so that two of the coupling members 213 may be provided on a first half portion 2121 (such as an upper half portion) of the base body 212, while another two of the coupling members 213 may be provided on a second half portion 2122 (such as a lower half portion) of the base body 212. Moreover, the two coupling members 213 on the first half portion 2121 of the base body 212 may be provided such that the two first coupling portions 2131 may be arranged to correspond to each other (i.e. facing each other), in which one of the receiving slots 211 may be formed at a space formed between the two first coupling portions 2131 of the two coupling members 213 on the first half portion 2122 of the base body 212.

On the other hand, the two coupling members 213 on the second half portion 2122 of the base body 212 may be provided such that the two second coupling portions 2132 may be arranged to correspond (i.e. face) the two second coupling portion 2132 of the two coupling members 213 on the first half portion 2121 of the base body 212 respectively, in which one of the receiving slots 211 may be formed by spaces formed between two corresponding second coupling portions 2132, while another one of the receiving slots 211 may be formed by spaces formed between another corresponding two second coupling portions 2132.

The two coupling members 213 on the second half portion 2122 of the base body 212 may also be provided such that the two corresponding first coupling portions 2131 may be arranged to correspond to each other (i.e. facing each other), in which another one of the receiving slots 211 may be formed at a space formed between the two first coupling portions 2131 of the two coupling members 213 on the second half portion 2122 of the base body 212.

The securing member 22 may be detachably mounted on the connecting members 11 of the relevant frame panels 10. Each of the securing member 22 may have a central portion 223 wherein the securing arms 221 may outwardly and integrally extend from the central portion 223. In this preferred embodiment of the present invention, each of the securing arms 221 may form an angle of inclination of approximately 90° with each adjacent securing arm 221. Each of the securing members 22 may have altogether four securing arms 221 extending from the central portion 223 thereof.

Thus, each of the securing arms 221 may have the securing slot 222 indently formed thereon, wherein each of the securing slots 222 may be shaped and size to correspond to those of the connecting members 11 of the frame panels 10. Each of the securing slot 222 may be arranged to accommodate a connecting member 11 of the frame panel 10, as shown in FIG. 4 of the drawings.

Figure 6:
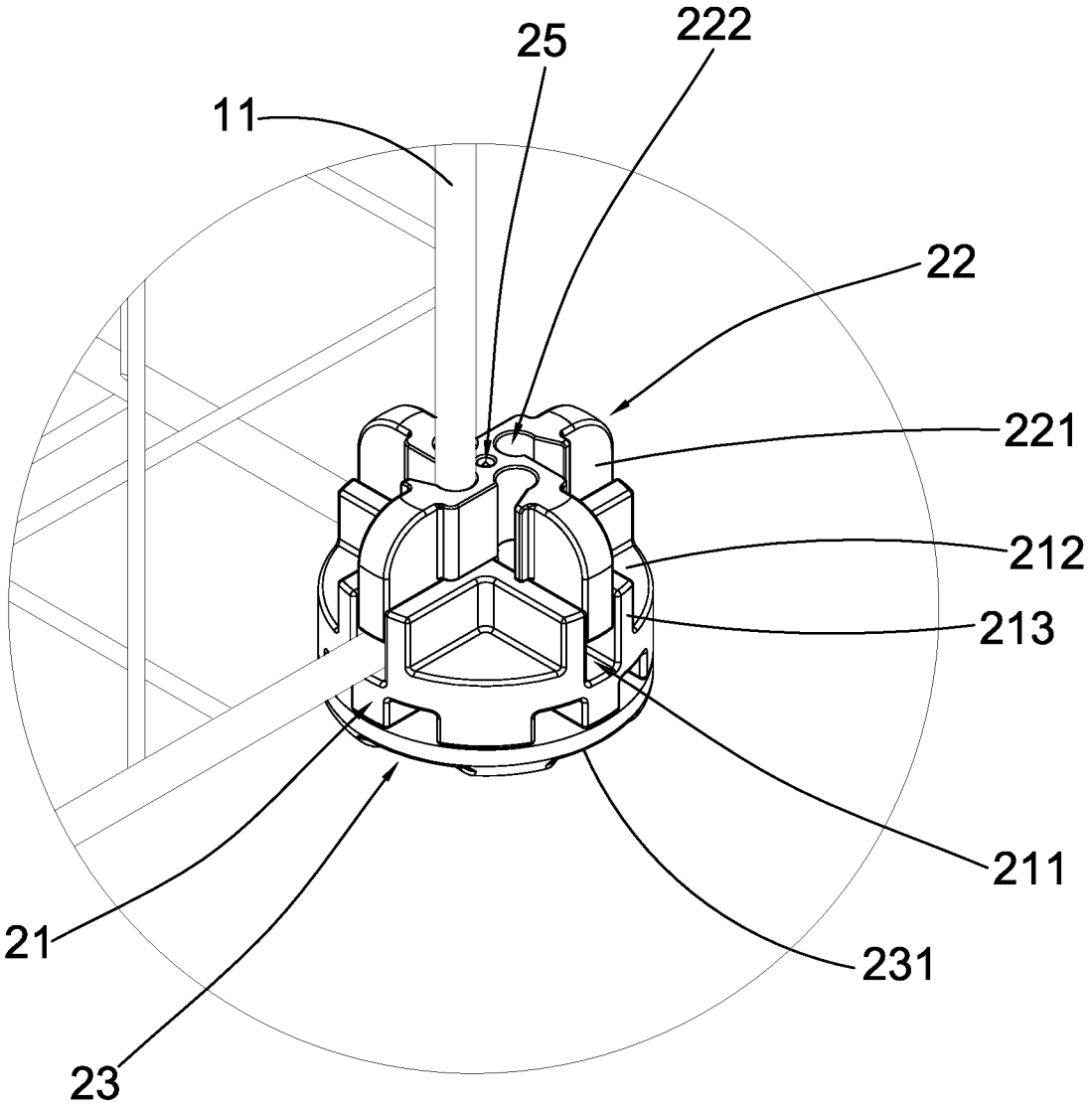
FIG. 6 is a perspective view of the connecting joint of the configurable storage and display frame according to the preferred embodiment of the present invention.
Figure 7:
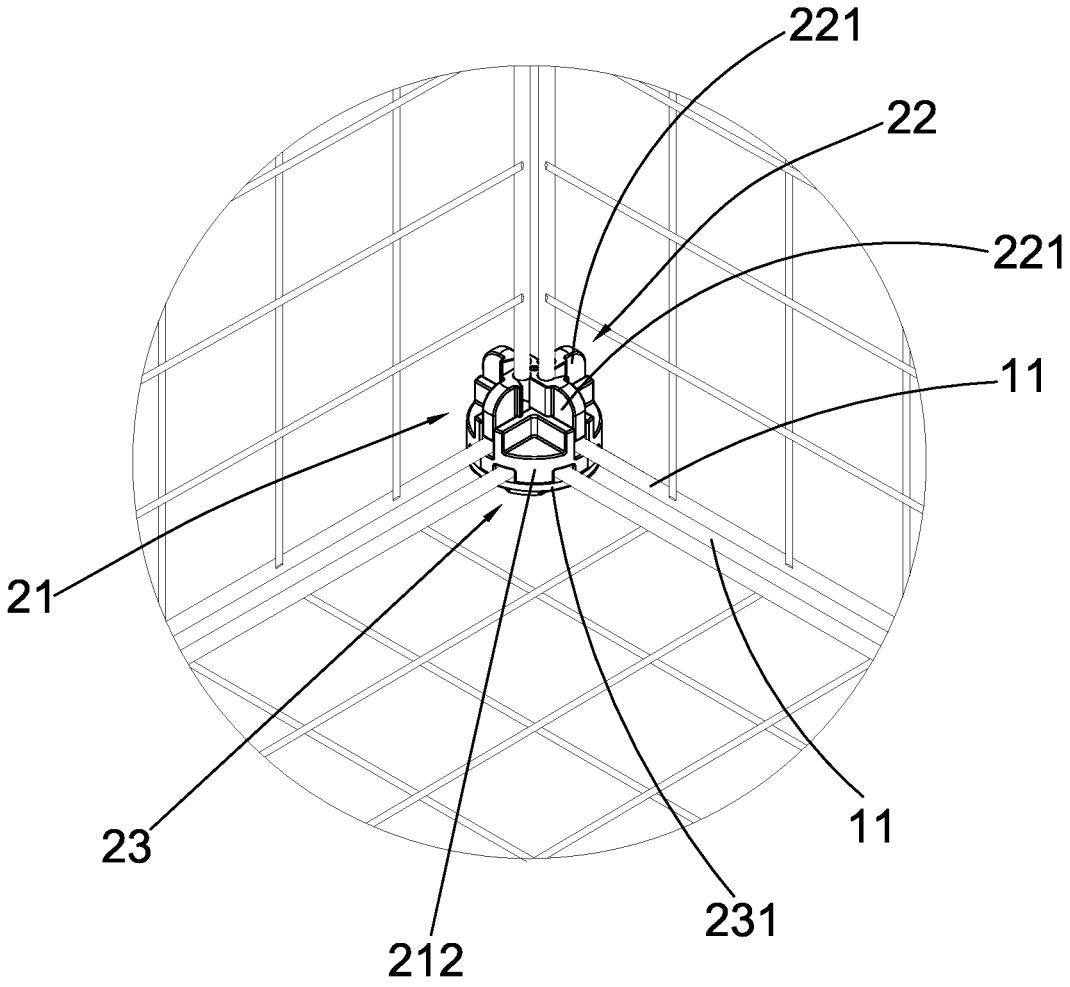
FIG. 7 is another perspective view of the connecting joint of the configurable storage and display frame according to the preferred embodiment of the present invention.

Moreover, each of the securing arm 221 may further have a securing portion 2211 arranged to receive in the corresponding receiving slot 211 when the securing member 22 is detachably attached on the base 21. Thus, each of the receiving slots 211 may be shaped and sized to correspond to those of the securing portions 2211 of the securing arms 221. Thus, when the securing member 22 is detachably attached on the base 21, the securing slots 222 may be mounted on the connecting members 11 while the securing portions 2211 may be securely received in the receiving slots 211 respectively. This configuration may be shown in FIG. 6 of the drawings.

It is worth mentioning that the securing member 22 may be configured by a material having a predetermined elasticity so that a user may easily couple a selected connecting member 11 into a corresponding securing slot 222. At the same time, the securing portions 2211 may be coupled to the receiving slots 211 respectively so as to reinforce a structural integrity of the securing member 22 when the securing member 22 is mounted on the frame panel 10.

Figure 4:
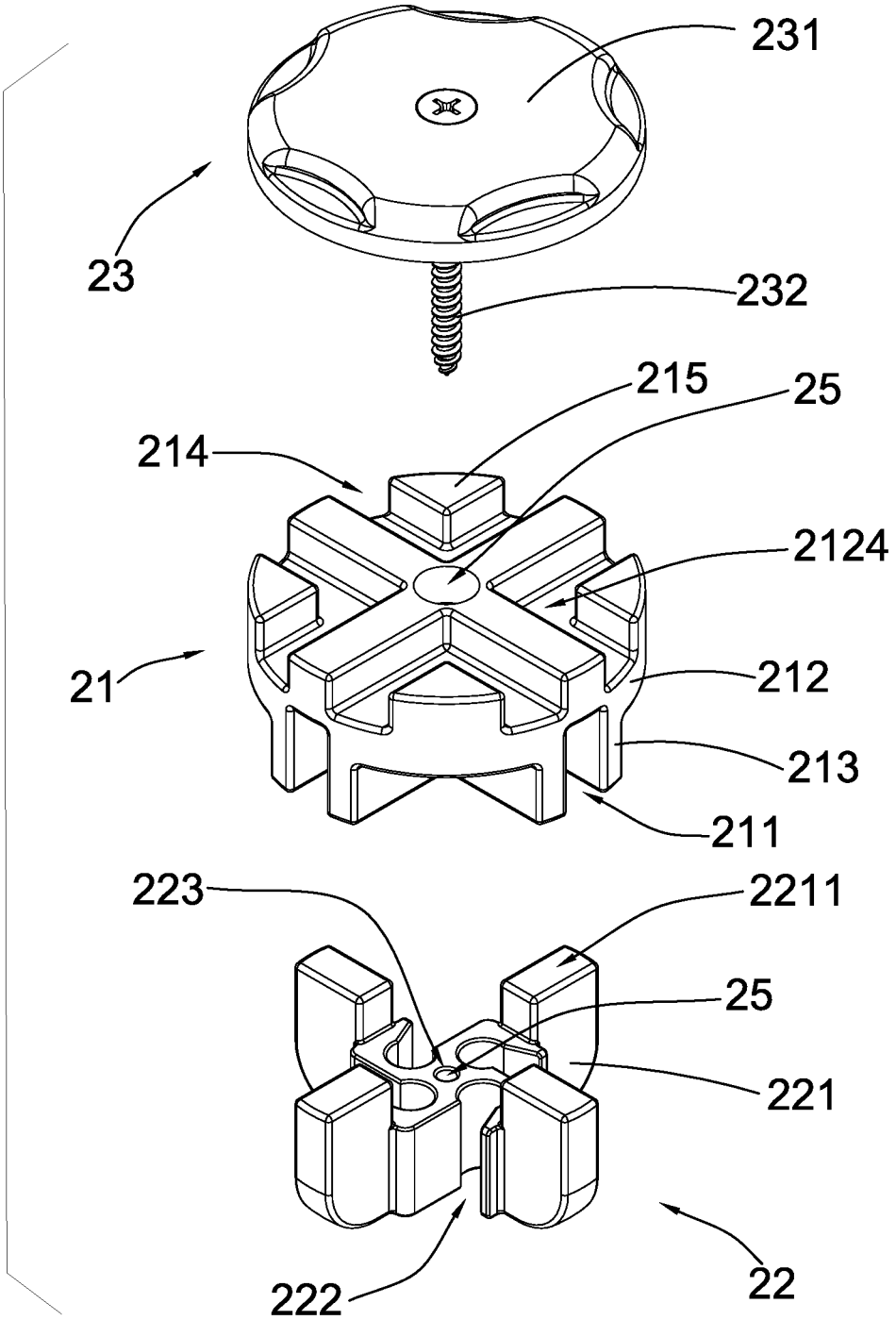
FIG. 4 is another exploded perspective view of the connecting joint of the configurable storage and display frame according to the preferred embodiment of the present invention.
Figure 5:
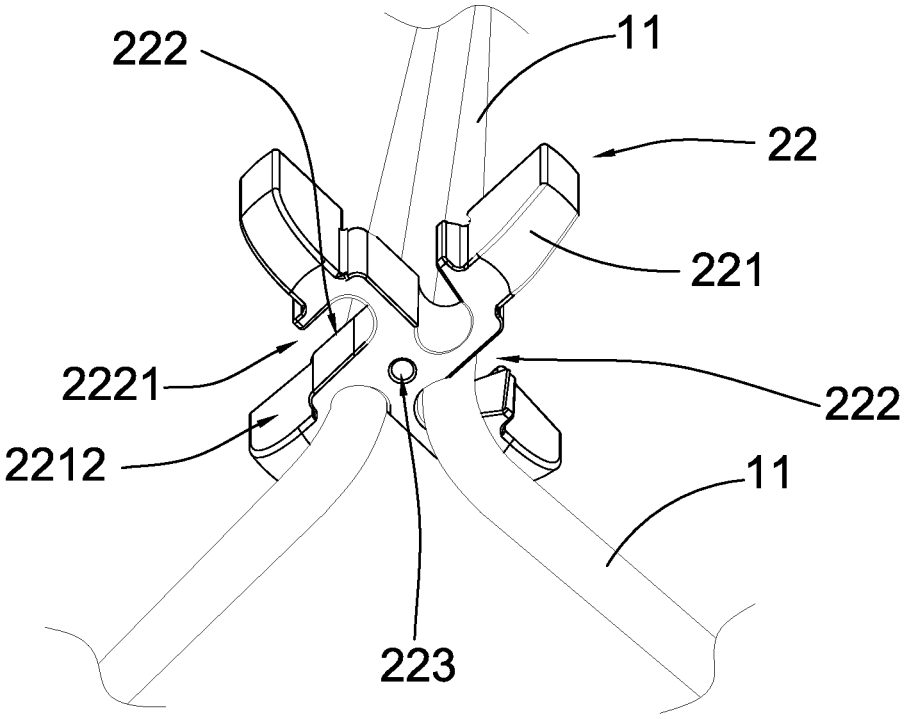
FIG. 5 is a schematic diagram of a configurable storage and display frame according to the preferred embodiment of the present invention, illustrating a connection between a frame panel and a securing member of a connecting joint.

As shown in FIG. 4 of the drawings, each of the securing slots 222 may be formed on the corresponding securing arm 221 in such a manner that an opening 2221 of the securing slot 222 may face toward a transverse direction of the securing arm 221 from which it extends. More specifically, the opening 2221 of the securing slot 222 may face toward or adjacent to a back surface 2212 of a corresponding adjacent securing arm 221.

In order to enhance a flexibility of the connecting joints 20 of the present invention, each of the base 21 may further have a plurality of guiding slots 214 formed on the base body 212 on the mounting surface 2124. Each of the guiding slots 214 may be arranged to accommodate at least one connecting member 11 of a corresponding frame panel 10 so as to allow mounting of frame panels 10 in a more flexible manner.

In this preferred embodiment, each of the connecting joints 20 may further comprise a plurality of guiding members 215 extended from the mounting surface 2124 of the base body 212, wherein the guiding slots 214 may be formed as spaces surrounded by at least two corresponding opposing guiding members 215. As shown in FIG. 4 of the drawings, the connecting joint 20 may comprise eight guiding members 215 in which four of the guiding members 215 may radially extend from the through hole 25 formed on the base body 212, while two of the guiding members 215 may be provided on the upper half portion 2121 of the base body 212 while the other two guiding members 215 may be provided on the lower half portion 2122 of the base body 212. In other words, the latter four guiding members 215 may be provided on four quadrants of the base body 212 which may be configured as having a circular cross section.

Each of the connecting joints 20 may further comprise a mounting member 23 detachably attached on the base 21 at an opposite side of the securing member 22. The mounting member 23 may comprise a mounting plate 231 and a connector 232 extending from the mounting plate 231. In this preferred embodiment, the connector 232 may be configured as a screw extending from the mounting plate 231 and may be arranged to penetrate through the base 21 and the securing member 22 so as to couple the base 21, the securing member 22, and the mounting plate 231 in a single unit.

Thus, the base body 212 may have a connecting surface 2123 and a mounting surface 2124 wherein the receiving slots 211 may be formed on the connecting surface 2123 while the mounting plate 231 may be mounted on the mounting surface 2124.

In other words, each of the securing member 22 and the base 21 may have a through hole 25 formed thereon, wherein the connector 232 may be arranged to penetrate the base 21 and the securing member 22 through the through holes 25 so as to couple the base 21, the securing member 22, and the mounting plate 231 in a single unit. The base 21 may therefore be sandwiched between the securing member 22 and the mounting plate 231.

The operation of the present invention may be as follows: a user may be able to mount the connecting members 11 of two or more frame panels 10 in the securing slots 222 of the securing member 22 so as to mount the frame panels 10 to form a desirable structure. After mounting the connecting members 11, the user may couple the base 21 with the securing member 22 in such a manner that the securing portions 2211 are received in the receiving slots 211 of the base 21 respectively. The base 21 and the securing member 22 may then form a coupled structure with enhanced structural integrity. Two or more frame panels 10 may then be joined by the connecting joint 20 of the present invention. Additional connecting members 11 of the frame panels 10 may be selectively received in the guiding slots 214 so as to allow a user to configure a desirable storage frame or a storage rack, such as the bottom of the storage cube shown in FIG. 2 of the drawings.

After that, the user may attach the mounting member 23 on the base 21 on the mounting surface 2124 while the connector 232 may penetrate the through holes 25 of the base 21 and the securing member 22. The connector 232 may be fastened against the base 21 and the securing member 22 so as to fasten the entire structure of the connecting joint 20 on the corresponding frame panels 10. As the result, up to eight connecting members 11 of the frame panels 10 can be received in both receiving slots 211 and guiding slots 214 and secured by fastening one connector 232 through the base 21 and securing member 22.

By coupling a plurality of connecting joints 20 to a plurality of frame panels 10, certain desirable storage and display racks may be formed. An exemplary configuration is shown in FIG. 2 of the drawings, in which a cubic storage and display rack may be formed by five frame panels 10 and eight connecting joints 20.

Figure 8:
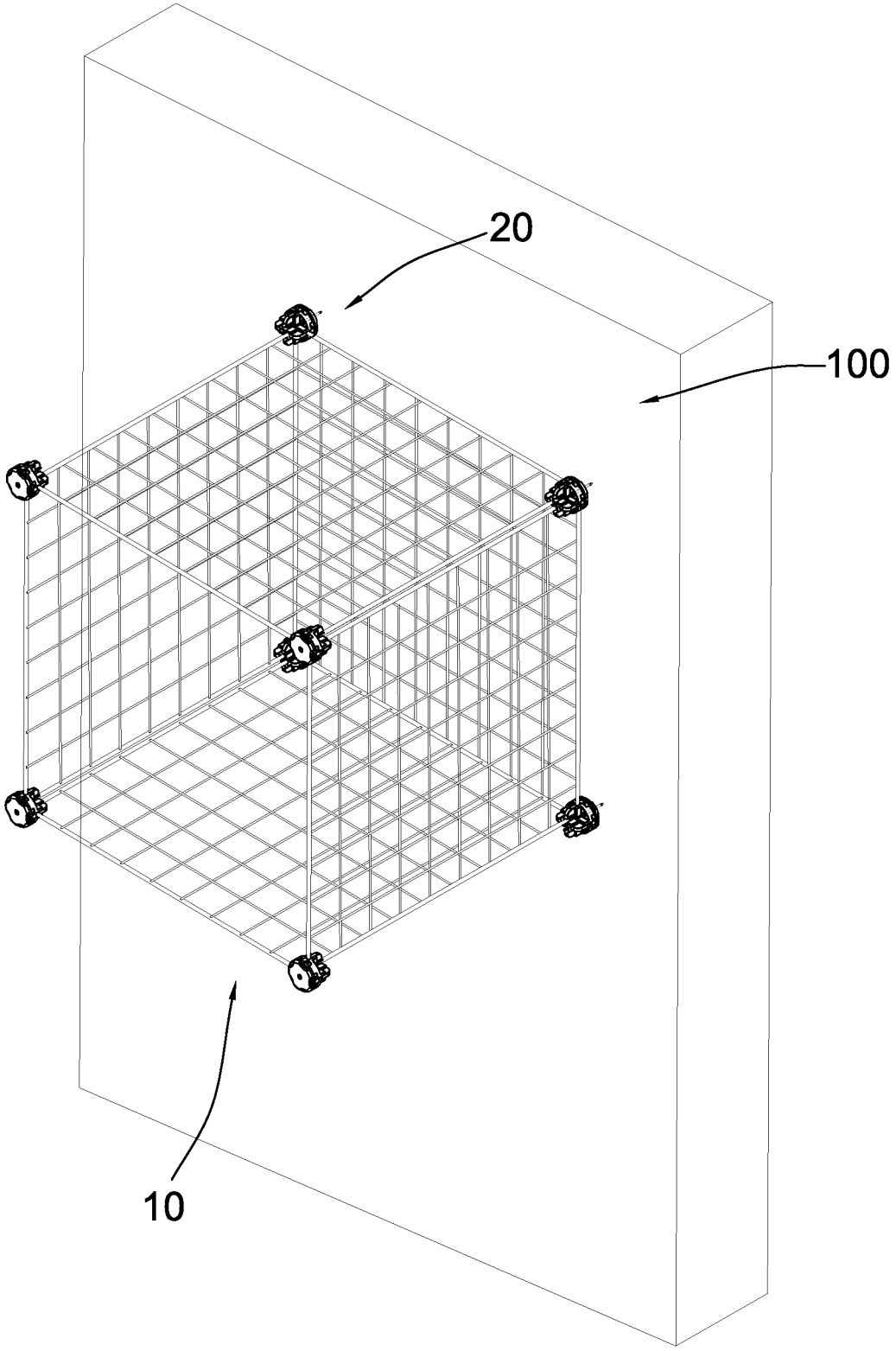
FIG. 8 is a first alternative mode of a configurable storage and display frame according to the preferred embodiment of the present invention, illustrating that the configurable storage and display rack can be hanged on a utility surface.
Figure 9:
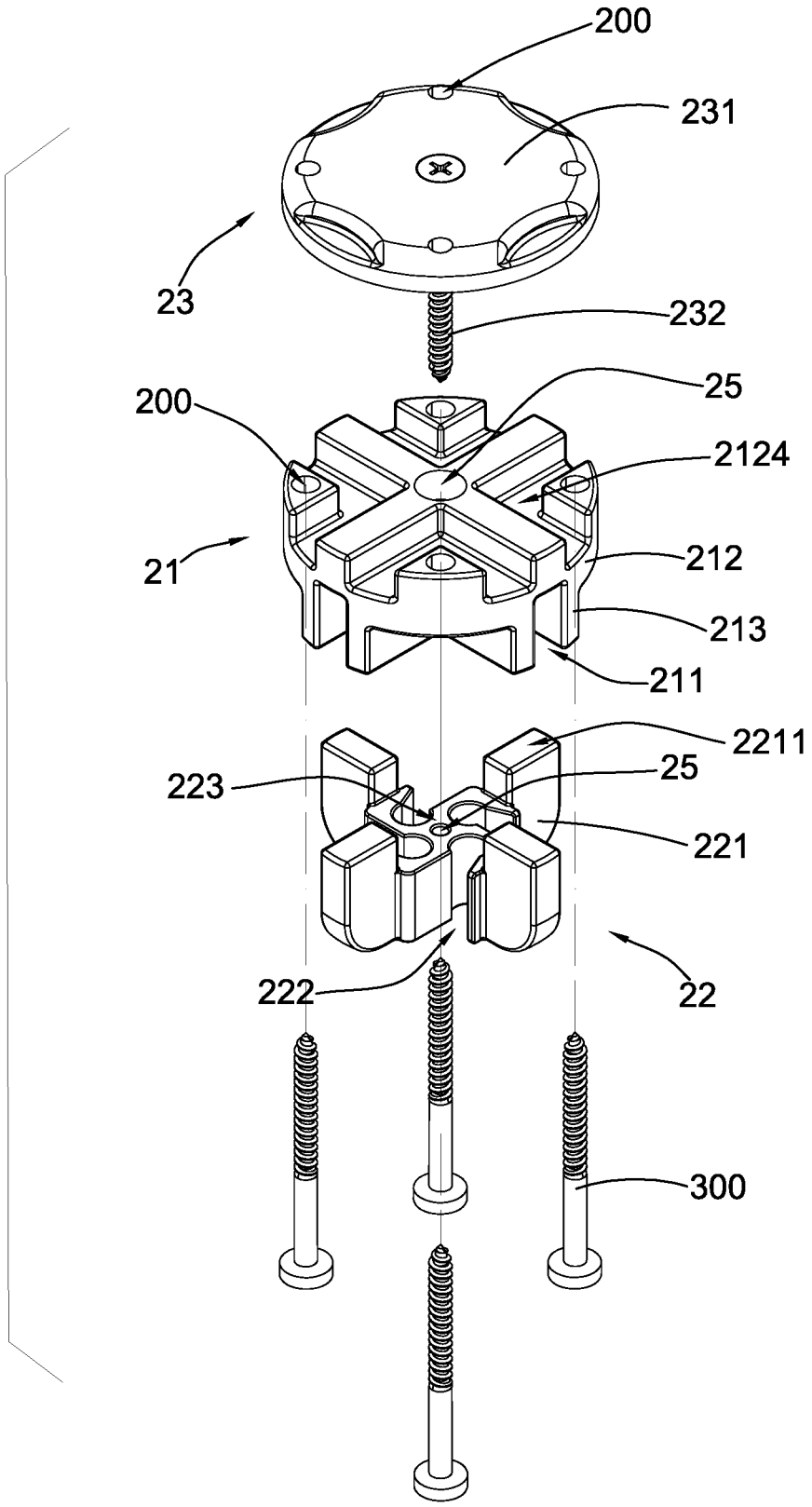
FIG. 9 is a perspective view of the connecting joint of the configurable storage and display frame according to the first alternative mode of the preferred embodiment of the present invention.

Referring to FIG. 8 and FIG. 9 of the drawings, a configurable storage and display frame according to a first alternative mode of the present invention is illustrated. The first alternative mode is identical to the preferred embodiment described above, except the way in which the various components of the configurable storage and display frame are mounted. In this first alternative mode, the frame panels 10 and the connecting joints 20 may also be configured to form a storage and display rack as shown in FIG. 2 of the drawings above. However, the configurable storage and display rack may be hanged on the utility surface 100, such as a vertical wall.

Specifically, each of the base body 212 and the mounting plate 231 may have a plurality of mounting holes 200, while the configurable and display frame may further comprise a plurality of mounting members 300, wherein the mounting members 300 may be arranged to penetrate through the mounting holes for mounting the base body 212 and the mounting plate 231 on the utility surface 100. As such, the configurable storage and display rack may be hanged at an elevated height.

It is worth mentioning that the connector 232 may be mounted on the mounting plate 231 through injection-molding so that the mounting member 232 and the mounting plate 231 may form an integral structure. One skilled in the art may appreciate that the present invention may facilitate tool-free assembling and disassembling of the configurable storage and display rack or frame. Moreover, the shapes of the base body 212 and the securing member 22 may be varied according to the circumstances in which the present invention is utilized or manufactured.

Figure 10A:
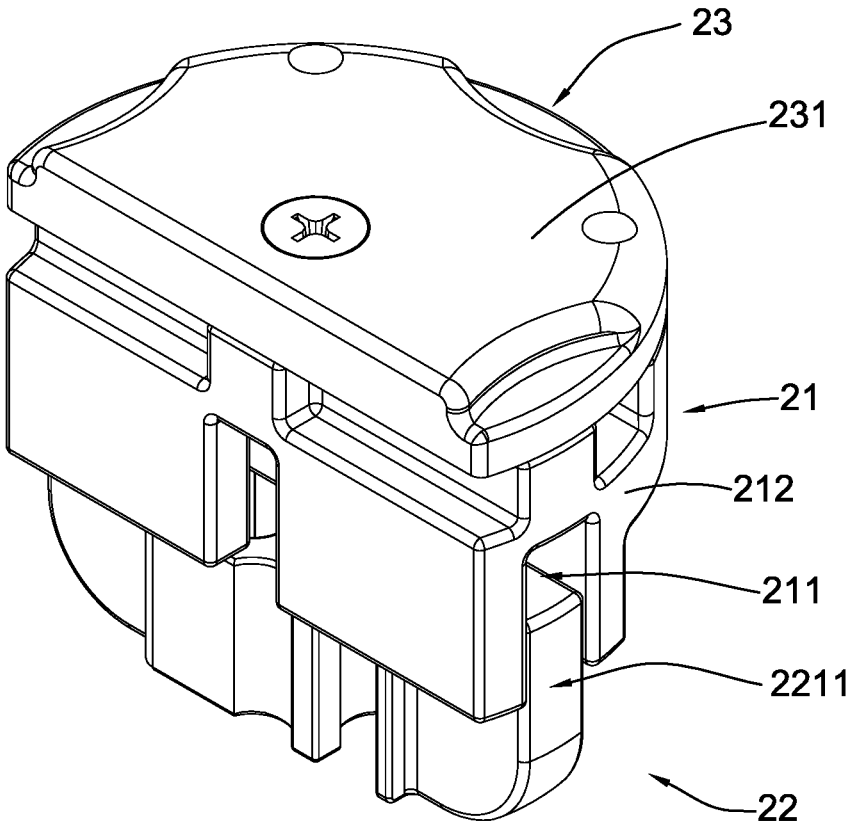
FIG. 10A and FIG. 10B are exemplary alternative configurations of the connecting joint of the configurable storage and display frame according to the preferred embodiment of the present invention.
Figure 10B:
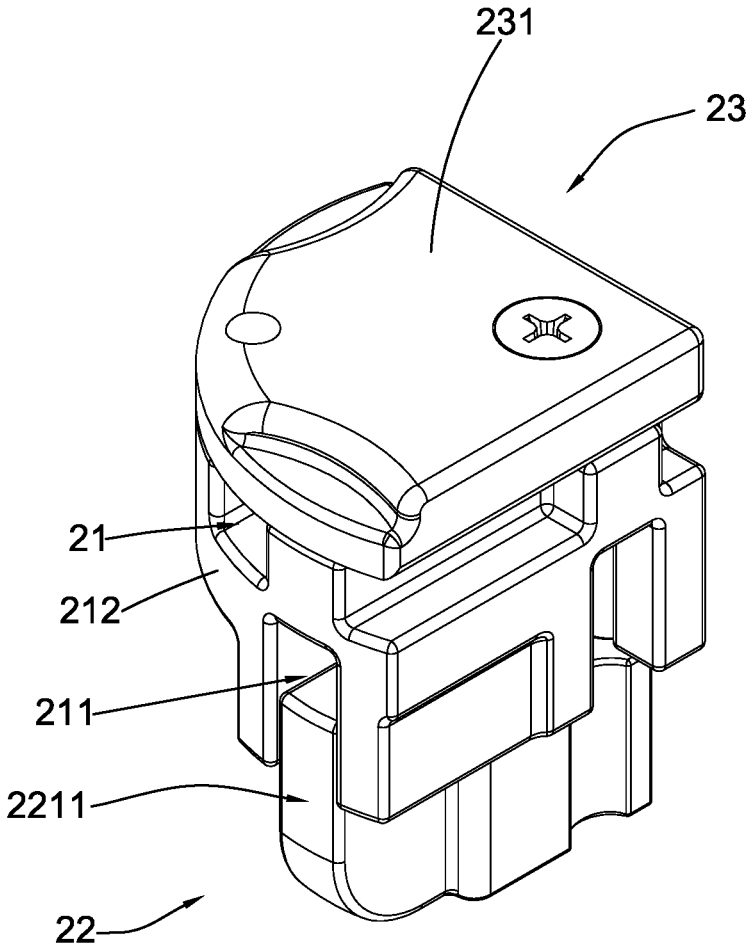

Moreover, a cross-sectional shape of the mounting plate 232, the base 21 and the securing member 22 may be varied so as to fit different mounting purpose. For example, as shown in FIG. 10A and FIG. 10B of the drawings, the base 21 and the mounting plate 232 of the mounting member 23 may be configured to have a semi-circular cross-sectional shape (see FIG. 10A) or a quadrant shape (FIG. 10B).

Embodiments of the present disclosure, while illustrated and described in terms of a preferred embodiment and several alternatives, is not limited to the particular description contained in this specification. Additional alternative or equivalent components could also be used to practice embodiments of the present disclosure.

What is claimed is:

1. A configurable storage and display frame, comprising:

a plurality of frame panels, each of said frame panels having at least one connecting member;

at least one connecting joint, comprising:

a base having a plurality of receiving slots formed thereon, said base comprising a base body having a mounting surface, and four coupling members spacedly extended from said base body along an axial direction thereof, each of said coupling members having a first coupling portion and a second coupling portion extended from said first coupling portion along a transverse direction thereof so as to form a substantially L-shaped cross section for each of said coupling members, said four coupling members being provided on four quadrants portions of said base body so that two of said coupling members are provided on a first half portion of said base body, while another two of said coupling members are provided on a second half portion of said base body, said two coupling members on said first half portion of said base body being provided such that two of said first coupling portions of two of said coupling members are arranged to correspond to each other respectively, in which one of said receiving slots is formed at a space formed between said two first coupling portions of said two coupling members on said first half portion of said base body, said two coupling members on said second half portion of said base body being provided such that two of said second coupling portions are arranged to correspond to two of said second coupling portions of said two coupling members on said first half portion of said base body respectively, in which one of said receiving slots is formed by spaces formed between two corresponding second coupling portions, while another one of said receiving slots is formed by spaces formed between another corresponding two second coupling portions, said two coupling members on said second half portion of said base body being provided such that said two of said first coupling portions are arranged to correspond to each other, in which one of said receiving slots is formed at a space formed between said two first coupling portions of said two coupling members on said second half portion of said base body; and a securing member which comprises a plurality of securing arms and a plurality of securing slots formed on said securing arms respectively, said connecting members of two of said frame panels being arranged to be securely received in said securing slots respectively, wherein said securing member is arranged to detachably attach on said base in such a manner that said securing arms are received in said receiving slots respectively so as to securely restrict a lateral movement between said securing member and said base for providing a joint of said connecting members of two of said frame panels, said base further having a plurality of guiding slots formed on said base body on said mounting surface, each of the guiding slots being arranged to accommodate at least one connecting member of said corresponding frame panel.

2. The configurable storage and display frame, as recited in claim 1, wherein said connecting joint further comprises a plurality of guiding members extended from said mounting surface of said base body, wherein said guiding slots are formed as spaces surrounded by at least two corresponding opposing guiding members.

3. A configurable storage and display frame, comprising:

a plurality of frame panels, each of said frame panels having at least one connecting member;

at least one connecting joint, comprising:

a base having a plurality of receiving slots formed thereon; and a securing member which comprises a plurality of securing arms and a plurality of securing slots formed on said securing arms respectively, said connecting members of two of said frame panels being arranged to be securely received in said securing slots respectively, wherein said securing member is arranged to detachably attach on said base in such a manner that said securing arms are received in said receiving slots respectively so as to securely restrict a lateral movement between said securing member and said base for providing a joint of said connecting members of two of said corresponding frame panels, said securing member having a central portion, said securing arms extending from said central portion, each of said securing arms further having a securing portion arranged to receive in one of said corresponding receiving slots when said securing member is detachably attached on said base, wherein each of said securing slots is formed on said corresponding securing arm in such a manner that an opening of said securing slot is arranged to face toward a transverse direction of said securing arm from which said securing arm extends.

4. A configurable storage and display frame, comprising:

a plurality of frame panels, each of said frame panels having at least one connecting member;

at least one connecting joint, comprising:

a base having a plurality of receiving slots formed thereon; and a securing member which comprises a plurality of securing arms and a plurality of securing slots formed on said securing arms respectively, said connecting members of two of said frame panels being arranged to be securely received in said securing slots respectively, wherein said securing member is arranged to detachably attach on said base in such a manner that said securing arms are received in said receiving slots respectively so as to securely restrict a lateral movement between said securing member and said base for providing a joint of said connecting members of two of said corresponding frame panels, wherein said connecting joint further comprises a mounting member detachably attached on said base at an opposite side of said securing member, said mounting member comprising a mounting plate and a connector extending from said mounting plate, said connector being arranged to penetrate through said base and said securing member so as to couple said base, said securing member, and said mounting plate in a single unit.

5. The configurable storage and display frame, as recited in claim 1, wherein said connecting joint further comprises a mounting member detachably attached on said base at an opposite side of said securing member, said mounting member comprising a mounting plate and a connector extending from said mounting plate, said connector being arranged to penetrate through said base and said securing member so as to couple said base, said securing member, and said mounting plate in a single unit.

6. The configurable storage and display frame, as recited in claim 2, wherein said connecting joint further comprises a mounting member detachably attached on said base at an opposite side of said securing member, said mounting member comprising a mounting plate and a connector extending from said mounting plate, said connector being arranged to penetrate through said base and said securing member so as to couple said base, said securing member, and said mounting plate in a single unit.

7. A connecting joint for joining at least two frame panels each having a connecting member, comprising:

a base having a plurality of receiving slots formed thereon, said base comprising a base body having a mounting surface, and a plurality of coupling members spacedly extended from said base body along an axial direction thereof, each of said coupling members having a first coupling portion and a second coupling portion extended from said first coupling portion along a transverse direction thereof so as to form a substantially L-shaped cross section for each of said coupling members, wherein said base further has a plurality of guiding slots formed on said base body on said mounting surface, each of the guiding slots being arranged to accommodate at least one connecting member of said corresponding frame panel; and a securing member which comprises a plurality of securing arms and a plurality of securing slots formed on said securing arms respectively, said connecting members of two of said frame panels being arranged to be securely received in said securing slots respectively, wherein said securing member is arranged to detachably attach on said base in such a manner that said securing arms are received in said receiving slots respectively so as to securely restrict a lateral movement between said securing member and said base for providing a joint of said connecting members of two of said corresponding frame panels.

8. The connecting joint, as recited in claim 7, further comprising a plurality of guiding members extended from said mounting surface of said base body, wherein said guiding slots are formed as spaces surrounded by at least two corresponding opposing guiding members.

9. The connecting joint, as recited in claim 7, wherein said securing member has a central portion, wherein said securing arms extend from said central portion, each of said securing arms further having a securing portion arranged to receive in one of said corresponding receiving slots when said securing member is detachably attached on said base.

10. The connecting joint, as recited in claim 7, wherein each of said securing slots is formed on said corresponding securing arm in such a manner that an opening of said securing slot is arranged to face toward a transverse direction of said securing arm from which said securing arm extends.

11. A connecting joint for joining at least two frame panels each having a connecting member, comprising:

a base having a plurality of receiving slots formed thereon; and a securing member which comprises a plurality of securing arms and a plurality of securing slots formed on said securing arms respectively, said connecting members of two of said frame panels being arranged to be securely received in said securing slots respectively, wherein said securing member is arranged to detachably attach on said base in such a manner that said securing arms are received in said receiving slots respectively so as to securely restrict a lateral movement between said securing member and said base for providing a joint of said connecting members of two of said corresponding frame panels; and a mounting member detachably attached on said base at an opposite side of said securing member, said mounting member comprising a mounting plate and a connector extending from said mounting plate, said connector being arranged to penetrate through said base and said securing member so as to couple said base, said securing member, and said mounting plate in a single unit.

12. The connecting joint, as recited in claim 7, further comprising a mounting member detachably attached on said base at an opposite side of said securing member, said mounting member comprising a mounting plate and a connector extending from said mounting plate, said connector being arranged to penetrate through said base and said securing member so as to couple said base, said securing member, and said mounting plate in a single unit.

* * * * *